United States Patent [19]

Speidel

[11] Patent Number: 4,677,792

[45] Date of Patent: Jul. 7, 1987

[54] CLAMPING OR CHUCKING SYSTEM FOR A GRINDING WHEEL OR DISK

[75] Inventor: Hans Speidel, Nürtingen, Fed. Rep. of Germany

[73] Assignee: Montanwerke Walter GmbH, Tübingen, Fed. Rep. of Germany

[21] Appl. No.: 846,866

[22] Filed: Apr. 1, 1986

[30] Foreign Application Priority Data

Apr. 4, 1985 [DE] Fed. Rep. of Germany ..... 3512366

[51] Int. Cl.[4] ..... B24B 41/04

[52] U.S. Cl. ..... 51/168; 279/2 A; 279/4; 82/44; 242/72 B

[58] Field of Search ..... 279/2 R, 2 A, 4 R, 83, 279/87, 89; 51/170 R, 170 T, 372, 373, 382, 168, 169, 166; 82/43, 44; 242/72 B, 72 R

[56] References Cited

U.S. PATENT DOCUMENTS

| | | | |
|---|---|---|---|
| 2,750,196 | 6/1956 | Peczynski | 82/44 |
| 2,970,843 | 2/1961 | Bourguignon | 279/2 R |
| 4,114,909 | 9/1978 | Taitel et al. | 242/72 B |
| 4,135,677 | 1/1979 | Warczak | 242/72 B |

FOREIGN PATENT DOCUMENTS

| | | | |
|---|---|---|---|
| 1777257 | 10/1971 | Fed. Rep. of Germany . | |
| 3407315 | 9/1985 | Fed. Rep. of Germany | 279/4 |

*Primary Examiner*—Z. R. Bilinsky
*Assistant Examiner*—A. Dougas
*Attorney, Agent, or Firm*—Frishauf, Holtz, Goodman & Woodward

[57] ABSTRACT

A radially expansible thin-walled expansion sleeve (13) is expansible under hydraulic pressure by pressing a piston element (17) against hydraulic fluid in a chamber, upon operation of a threaded bolt (18) in a threaded bore (19) in the spindle (11) or an attachment element (12) connected thereto. To prevent loss of the grinding disk, and provide a safety interlock in case of leakage of hydraulic fluid and hence loss of frictional engagement due to the expansion sleeve, a safety lock is formed by a sleeve element (22) which has resilient tines (24) extending therefrom, formed with locking projections (25), radially expanded behind a shoulder (30) formed on a disk holding bushing (1) upon tightening of the bolt (18). The tines (24) have internal camming surfaces (26) which engage against conical surfaces (27) located on the spindle (11) or the attachment (12) thereto. The spindle or the attachment and the disk holding bushing are, additionally, coupled for conjoint rotation by engagement pins (31) fitting into respective reception openings (32).

20 Claims, 2 Drawing Figures

CLAMPING OR CHUCKING SYSTEM FOR A GRINDING WHEEL OR DISK

Reference to related publication: German Patent DE-PS No. 17 77 257.

The present invention relates to grinding machines, and more particularly to a system and apparatus to securely retain a grinding wheel or grinding disk on a machine spindle with an intermediate coupling elelment, to form a rotation transmitting chucking or clamping arrangement which is reliable, easy to loosen, while safe in operation by including an interlock preventing loosening of the wheel from the spindle.

BACKGROUND

Various types of arrangements are known to clamp a grinding disk on a spindle. Usually, an essentially cylindrical coupling element is provided which has a cylindrical reception pin to receive the central hole of a grinding disk. A washer can be tightened against a shoulder on the coupling element by a threaded bolt, inserted into the coupling element. The coupling element, at the other end, is formed with either a tapered bore or a taper pin, which fits, respectively, against a tapered extension of the spindle or into a tapered reception bore of the spindle or another coupling element. An axial bolt connects the respective elements together.

The tapered connection, being a generally cone-shaped connection of very steep cone angle, permits rotation of the grinding disk exactly coaxially with resepct to the axis of the spindle. Yet, the connection is not stiff or resistant against some bending. It has been found difficult to remove the coupling element from the spindle due to the tapered interconnection, since the tapered engagement of bore-and-cone tends to become so tight that an inherent clamping effect, due to the axial tightening of the elements against each other, first must be released. Exchange of grinding disks, therefore, and particularly if grinding disks are to be exchanged automatically in an automatic machine tool, causes difficulty.

It is very important that unintended release of the grinding disk from the spindle be inhibited. Grinding wheels operate at high speed, and safety requires, specifically in machines with automatic tool interchange, that the disk cannot be released from the spindle unintentionally. If a portion or component of the chucking or clamping arrangement should fail, for example due to forces which arise in the operation of the machine, the tool on the automatic machine must not come loose therefrom. In grinding machines, operating at high speeds, this is particularly important.

THE INVENTION

It is an object to provide a clamping or chucking arrangement, particularly for a grinding disk, which permits ready exchange of the grinding disk, that is, release of a clamping force, requiring only small clamping or releasing forces, and which, further, positively inhibits unintended release of the disk from the reception element by providing a safety interlock. The system, further, should be compact and be automatically operable, that is, not require special intervention for release of a safety interlock or a special operating sequence therefor.

Briefly, a coaxial cylindrical bore is formed in a holding bushing, and the spindle, or a clamping element therefor attached thereto, is formed with a hydraulic expansion system which includes a resiliently expandable thin-walled expansion sleeve. The hydraulic pressure can be increased or released by operating an axially movable fluid compression piston, which, through an operating element which is externally accessible, provides hydraulic pressure into the chamber and, thereby, expansion of the thin-walled sleeve to clamp the coupling bushing. To prevent unintended release, axially operating safety latching locks are provided, formed on the spindle and on the disk holding bushing, respectively, for example in the form of externally projectable locking levers or sears, engaging behind a shoulder of the bushing. The locking elements are moved outwardly, when the spindle is engaged, and can retract upon releasing movement thereof.

The combination structure has the advantage that malfunction of the hydraulic expansion system will not cause release of the grinding disk or grinding wheel, but retain the grinding wheel in clamped condition. Hydraulic expansion elements to hold machine tools are known already—see, for example, German Patent No. 17 77 257. In prior art arrangements, however, in case of malfunction for example due to failure of a seal, loss of pressure could result which decreases or entirely eliminates the clamping effect. The system in accordance with the present application, in contrast, has the additional safety interlock so that, even if there should be loss of pressure of the clamping element, the grinding disk or wheel, which may operate at high speed, cannot come loose from the spindle. The interlock is reliably engaged upon connecting the grinding wheel or disk initially; no additional operations are needed which could be overlooked or forgotten by an operator, or may cause additional operating steps in an automatic machine. The system is simple, so that, itself, will not introduce additional sources of error or malfunction.

DRAWINGS

FIG. 1 shows a chucking arrangement in axial, part-sectional view, with the grinding disk attached; and FIG. 2 is a view similar to FIG. 1, with the disk released.

DETAILED DESCRIPTION

Figure 1:
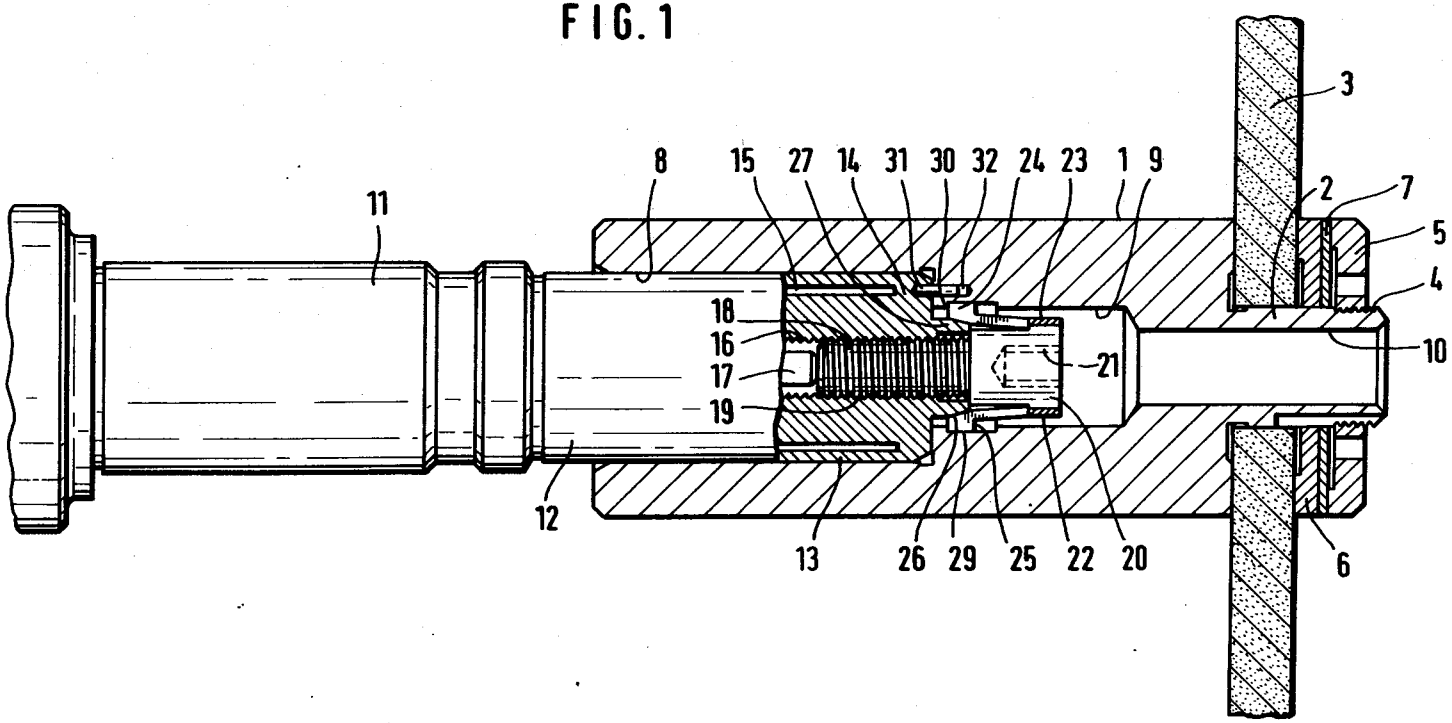

The arrangement has a cylindrical holding bushing 1, which, at one end, has a projecting pin 2 of reduced diameter. The pin 2 is, preferably precisely, coaxial with the bushing 1, and coaxial with the axis of rotation of the spindle, shown schematically by a center line. A shoulder formed between the projecting pin 2 and the remainder of the bushing 1 forms an engagement surface for a grinding disk 3. Grinding disk 3 has a central bore, fitting over the projection 2. The projection 2 is formed with an external thread and a nut 5, with a washer 6 and a somewhat resilient compression washer 7 interposed therebetween, is threaded on the threads 4 of the projection 2 to hold the grinding disk 3 on the bushing 1. This is, generally, standard construction.

The end portion of the holding bushing 1 opposite the disk 3 is formed with a coaxil cylindrical bore 8 which extends, further, into a coaxial bore 9 of smaller diameter, terminating towards the disk end in a further bore 10 of still smaller diameter, so that the bushing 1, internally, has a stepped bore configuration which extends through the bushing.

The spindle 11 of the grinding machine—not further shown—is coupled at its end to a coupling element 12.

The coupling element 12 is not strictly necessary and the spindle 11 may, inherently, have the hydraulic arrangement to be described. For machine tools in which the working head is interchangeable, however, it is desirable to couple the coupling element 12 to the spindle 11. The coupling element 12 if formed as a hydraulic expansion element. The hydraulic expansion element terminates in a coaxial thin-walled cylindrical expansion sleeve 13, capable of being expanded radially outwardly, upon application of hydraulic pressure within the expansion sleeve. The expansion sleeve 13 defines an expansion chamber 15, for example in form of a ring slit, which communicates over suitable ducts with a coaxial longitudinal bore 16 formed, for example, in the element 12. Of course, as noted, the element 12 may be integral with the spindle 11 and, in that case, the spindle 11 will be formed with the thin-walled expansion sleeve, and the chamber 15 will be formed therein. A hydraulic pressure medium, for example oil, is filled into the chamber 15 and the bore 16. The chamber 15 is formed in a forward portion 14 of the element 12. The element 12 is suitably secured to the spindle 11, for example by a circumferential holding nut, as schematically shown in FIG. 1, and as well known, and which may be of standard construction.

The oil within the chamber 15 and the communicating bore 16 is compressed by sliding a piston 17 into the interior of the bore 16. Upon movement of the piston towards the left in FIG. 1, oil will be forced into the region adjacent the expansion sleeve, so that the thin-walled expansion sleeve 13 will be uniformly radially outwardly expanded to clamp the holding bushing 1 securely to the element 12, and hence to the spindle 11.

The piston 17, which may be in form of a bolt, is engaged by an operating engagement element in form of a coaxial screw or bolt 18 which is screwed into a projecting threaded extension 19 of the bore 16. The threaded extension 19 receives a projecting portion of the piston or piston bolt 17. The threaded bolt 18 has a head 20 with an internal hexagonal opening, to receive an Allen wrench therein. Any other arrangement to engage a releasing tool with the bolt 17 may be used. The piston or bolt 17 and the screw-bolt 18 can be suitably connected, for example by a C-snap ring or the like fitting about a groove formed in the bolt extension of the piston 17.

In accordance with a feature of the invention, and to provide a safety interlock, a spreading sleeve 22 is fitted on the bolt 18. The spreader sleeve 22 has an initial ring-like portion 23 and terminates, at its inner end, that is, at its left end in FIG. 1, in longitudinally slit, outwardly resilient jaw elements 24. Each one of the jaw elements 24 carries a radially projecting locking projection 25. The jaws 24, in the region of the locking projections 25, have internal conical surfaces 26 with which they seat on a suitably conically shaped projecting portion of the element 12—or on the spindle 11, if the element 12 and the spindle 11 form a single structural unit. The conical portion 27 could, also, be a separate, essentially frusto-conical part having a suitable axial bore to permit passage of the bolt 18 therethrough.

The bushing 1 is formed with a ring groove 29 which defines, in the region towards the grinding disk 3, a ring-shaped locking shoulder 30, cooperating with the locking projections 29.

OPERATION, AND LOCKING OF A GRINDING DISK

Figure 2:
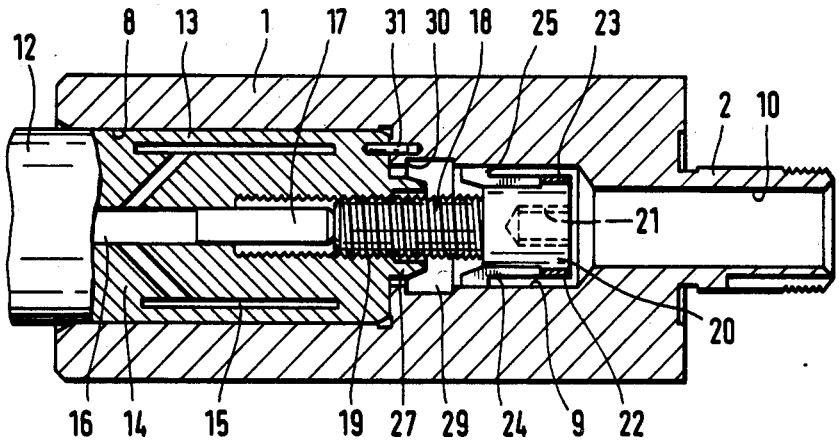

The disk 3 is placed on the projection 2 and secured in position, in accordance with standard arrangements, by the nut 5 and the clamping bushings 6, 7. The thus preassembled disk holding bushing 1, with the grinding disk 3 thereon, is slipped over the expansion sleeve 13. The expansion sleeve 13 is not tensioned, so that the expansion sleeve 13 will fit freely, but snugly, within the reception bore 8 of the bushing 1. The bolt 18 is screwed outwardly—see FIG. 2—so that the jaws 24 of the spreader sleeve 22, due to the inherent elasticity, will be located in a radially inwardly directed position. The locking projections 29 will have play within the bore 9 of the holding bushing 1. This arrangement easily permits sliding of the holding bushing 1 on the element 12 of the spindle 11 or, if the elements are integral, on the spindle 11 as such.

When the holding bushing 1 is fully engaged over the element 12, that is, when the element 12 with its wider portion 14 fits against an inner shoulder of the bushing 1, due to the difference in diameter between bores 8, 9, bolt 18 is tightened by being moved toward the left in FIG. 1 by engaging an Allen head wrench with the hexagonal interior 21 of the head of the bolt. The wrench is passed through the longitudinal bore 10. Upon tightening of bolt 18, the bolt-and-piston 17 is axially pressed into the bore 16 of the element 12, introducing hydraulic pressure into the chamber 15 and thus radially expanding the sleeve 13. With respect to FIGS. 1 and 2, the bolt will move towards the left. During this movement towards the left of head 20 of the bolt, spreader sleeve 22 is carried along and the jaws 24 will engage with their conical surface 26 the conical projection 27. As a consequence, the jaws 24 will be pressed radially outwardly and the locking projections 25 will be pressed into the ring groove 29, located in the bushing 1 in the region of the bore 9—see FIG. 1—thereby interlocking behind the shoulder 30.

Tightening of the bolt 18, thus, has the dual effect of, on the one hand, providing for precise positioning of the bushing 1 coaxially with respect to the spindle 11 due to the hydraulic pressure applied to the expansion sleeve 13 and, further, interengaging the locking projections 25 on the projecting jaws 24 with the groove 29 and behind the shoulder 30 to provide an interlocking axial safety lock for the bushing 1 on the element 12, or the spindle 11, directly. Thus, if for example, there should be pressure loss in the chamber 15, resulting in decrease or complete elimination of expansion pressure by the pressure sleeve 13, the bushing 1, and with it the grinding disk 3, which may then be operating at high speed, cannot come free from the spindle 11.

To release the bushing 1, and with it the grinding disk 3, for example upon change of tools to be applied to the spindle 11, it is only necessary to introduce a suitable Allen screw 18 through the opening 10 to release and screw out the screw 18. This has the simultaneous effect of releasing the hydraulic pressure, thus permitting the expansion sleeve to contract and eliminate the clamping pressure against the walls defining the bore 8 of the bushing 1 and, further, permitting the bushing 1 to be withdrawn from the element 12 and/or the spindle 11. Upon withdrawal movement, that is, in FIGS. 1 and 2 towards the right, the spreader sleeve 22 is necessarily carried along, so that the conical surfaces 26 on the jaws 24 will be released from engagement with the spreader surfaces on the extension cone 27, and the jaws 24, based on their inherent elasticity, can snap radially towards each other to assume the position shown in FIG. 2 and release from the shoulder 30. The bushing 1, with the grinding disk 3 thereon, thus can be removed from the element 12 and/or the spindle 11.

In case of malfunction, and for example if there should be pressure loss in the chamber 15, the clamping effect of the sleeve 13 may decrease or entirely disappear. For safety, the disk 3 should not be stopped before the spindle 11 itself has been disconnected from a drive system, for example a motor. Ordinarily, premature stopping of the disk 3 leads to fracture of the disk. In addition to the rotary coupling by the expansion sleeve 13, a further coupling connection is provided in the form of a safety pin 31 which is fitted in an end portion of the sleeve 13 or of the element 12, and engageable in a bore 32 formed in the bushing 1. The pin 31 and the bore 32 extend parallel to the axis of rotation to provide an additional rotary coupling between the element 12 and the bushing 1. A plurality of such pins 31 and bores 32 may be provided. Other suitable interengaging couplings, for example cooperating teeth, or other interlocking projection-and-recess connections may be used to couple the bushing 1 to the element 12 for transmission of rotation between the spindle 11 and the bushing 1, and hence the disk 3 if there should be loss of pressure expanding the sleeve 13.

The spreader elements 24, 25 interengaging with groove 29 and shoulder 30, form a simple and preferred interengaging lock, which is readily releasable, easily made, and reliably prevents inadvertent release of the bushing 1 from the spindle 11 and/or the element 12 in case of pressure loss, causing contraction, by the inherent resiliency, of the expansion sleeve 13. Utilizing a threaded bolt 18 has the advantage of simplicity and ease of operation, both by an operator as well as under automatic control.

The spreader sleeve 22 is readily made of springy material, having an integral, ring-like element 23, and extending jaws 24, formed by longitudinal slits terminating short of the ring portion 23. The sleeve 22 can readily be fitted with the locking projections 25, fitting behind the shoulder 30 of the groove 29, and readily expandible by engagement of interior conical surfaces with the cone surfaces of the cone 27 forming part of the spindle or of the element 12. The spreader sleeve is small, and can be inserted into the opening or bore 9. The conical element 27, likewise, can be a small separate part. Neither the conical element 27 nor the spreader sleeve 25 require radial enlargement of the bushing 1 over and beyond the size customarily used to provide an end bearing surface for the grinding disk or wheel 3. Likewise, no additional machining or internal working of the bushing 1 is necessary.

The coupling element formed by pin 31 and bore 32 reliably and very simply prevents stoppage of the disk 3 before the spindle 11 has stopped rotating. Since the spindle 11 may continue to be driven, even though pressure in chamber 15 is lost, and the disk 3, as a grinding disk, will be subjected to friction, loss of coupling may result in manufacture of scrap by the workpieces and, what would be worse, breakage of the grinding disk 3. The pin—bore arrangement 31, 32 is a simple and preferred construction; other arrangements, such as ball-and-detent connections, for example spring-loaded, or spring-loaded pin—detent or pin—bore connections, interengaging teeth and the like, may also be used.

Various changes and modifications may be made within the scope of the inventive concept.

I claim:

1. Chucking or clamping system for connecting a grinding wheel or disk (3) to a drive spindle (11) having a disk holding bushing (1) formed with an end surface for engagement with the grinding disk (3) at one end of the bushing and further formed with means coaxial with the grinding disk, for selectively releasably coupling the bushing (1) to the spindle (11), wherein said releasable coupling means comprises a coaxial cylindrical bore (8) formed in the holding bushing (1);

a hydraulic expansion system formed on one end portion of the spindle (11, 12) and located in the bore (8) of the holding bushing (1), said hydraulic expansion system including a radially expansible thin-walled expansion sleeve (13), a hydraulic pressure chamber (15) defined within said expansion sleeve for reception of a hydraulic pressure fluid, an axially movable fluid compression piston (17) extending into the pressure chamber, and an axially movable engagement element (18) which is externally accessible and operatively coupled to the fluid piston, said expansion sleeve, upon being subjected to hydraulic pressure, expanding to clamp the spindle (11, 12) coaxially in the bore (8) of the holding bushing (1);

and an interengaging axially latching safety locking means (25–30) coupled, respectively, to the spindle (11, 12) and the disk holding bushing (1), and movable to interengage and latch together said spindle and said bushing, said engagement element (18) being operatively coupled to said interengaging safety locking means for, simultaneously, upon axial movement of said engagement element, (a) interengagingly attaching the safety locking means (25–30) to latch together the spindle (11, 12) and the disk holding bushing (11); and (b) applying, via said compression piston (17), hydraulic pressure on the pressure fluid in said chamber (15) to thereby coaxially clamp the holding bushing (1) and the spindle (11, 12) together.

2. System according to claim 1, wherein said engagement element (18) comprises a coaxial bolt which is externally accessible from that side of the system at which the grinding disk (3) is attached to said bushing (1).

3. System according to claim 1, wherein the disk-holding bushing (1) forms a first locking part, and the spindle (11, 12) forms a second locking part; and wherein said safety locking means includes a spreader element (22) axially coupled to one of said parts, and radially movable, and a locking shoulder (30) formed on the other of said parts and located for engagement by said spreader element (22).

4. System according to claim 3, wherein the spreader element comprises a radially resiliently expansible spreader sleeve, and said locking shoulder is located in the path of the spreader sleeve upon the spreader sleeve being spread apart due to axial movement of the engagement element (18).

5. System according to claim 4, further including a spreading cone (27), coupled to said engagement element (18) and laterally spreading the spreader element.

6. System according to claim 1, wherein the engagement element (18) comprises a bolt, screwed into a tapped opening (19) formed in the spindle (11, 12); and wherein the disk holding bushing (1) is formed with an axial bore (10) aligned with said bolt to provide access to an operating head (21) of the bolt.

7. System according to claim 3, wherein the engagement element (18) comprises a bolt, screwed into a tapped opening (19) formed in the spindle (11, 12); and wherein the disk holding bushing (1) is formed with an axial bore (10) aligned with said bolt to provide access to an operating head (21) of the bolt.

8. System according to claim 7, further including locking projections (25) secured to the spreader element (22); and wherein the locking shoulder (30) comprises a shoulder portion positioned on the other of said parts and located for engagement with said locking projections upon threading of said bolt (18) into the bore (19).

9. System according to claim 8, further including a spreading cone (27) located on said spindle and engageable with the spreader element to spread the locking projections in engagement with the locking shoulder (30).

10. System according to claim 7, wherein the spreader element comprises a sleeve structure (22) having a wing portion (23) and resilient extending tines having said locking projections (25) formed thereon and defining an inclined camming surface (26); and a spreading cone (27) having an inclined engagement surface, engageable with said camming surface for spreading the tines and engagement of the locking projections (25) with said shoulder (30).

11. System according to claim 1, further including a safety rotation coupling (31, 32), rotatably interconnecting the disk holding bushing (1) and the spindle (11, 12), said coupling comprising interengaging, axially directed projection-and-recess means, coupling said bushing and said spindle together upon axial engagement of the bushing on the spindle regardless of presence of hydraulic pressure in said expansion sleeve (13).

12. System according to claim 3, further including a safety rotation coupling (31, 32), rotatably interconnecting the disk holding bushing (1) and the spindle (11, 12), said coupling comprising interengaging, axially directed projection-and-recess means, coupling said bushing and said spindle together upon axial engagement of the bushing on the spindle regardless of presence of hydraulic pressure in said expansion sleeve (13), the interengaging safety locking means (25–30) preventing axial separation of the disk holding bushing and the spindle (11, 12) and the safety rotation coupling (31, 32) insuring conjoint rotation of the disk holding bushing (1) and the spindle (11, 12).

13. System according to claim 1, wherein the spindle comprises a rotation transmitting machine spindle (11) and an attachment element (12) rotatable therewith, said radially expansible thin-walled expansion sleeve (13) being formed in said attachment element.

14. System according to claim 13, wherein the engagement element (18) comprises a screw, screwed into a tapped opening (19) formed in the attachment element (12), and wherein the disk holding bushing (1) is formed with an axial bore (10) aligned with said bolt to provide access to an operating head (21) of the bolt.

15. System according to claim 3, wherein the spindle comprises a rotation transmitting machine spindle (11) and an attachment element (12) rotatable therewith, said radially expansible thin-walled expansion sleeve (13) being formed in said attachment element.

16. System according to claim 15, wherein said engagement element (18) comprises a coaxial bolt which is externally accessible from that side of the system at which the grinding disk (3) is attached to said bushing (1).

17. System acording to claim 7, wherein said bolt is externally accessible from that side of the system at which the grinding disk (3) is attached to said bushing.

18. System according to claim 17, wherein the spindle comprises a rotation transmitting machine spindle (11) and an attachment element (12) rotatable therewith, said radially expansible thin-walled expansion sleeve (13) being formed in said attachment element.

19. System according to claim 12, wherein the engagement element (18) comprises a bolt, screwed into a tapped opening (19) formed in the spindle (11, 12); and wherein the disk holding bushing (1) is formed with an axial bore (10) aligned with said bolt to provide access to an operating head (21) of the bolt.

20. System according to claim 19, wherein the spindle comprises a rotation transmitting machine spindle (11) and an attachment element (12) rotatable therewith, said radially expansible thin-walled expansion sleeve (13) being formed in said attachment element.

* * * * *